US007854629B1

(12) United States Patent
Albers et al.

(10) Patent No.: US 7,854,629 B1
(45) Date of Patent: Dec. 21, 2010

(54) POWER PLUG SYSTEM FOR SUBMERSIBLE PUMP SYSTEM

(75) Inventors: Thomas Albers, Ahrensburg (DE); Axel-Helmut Tank-Langenau, Remmels (DE); Stefan Wittenberg, Bargtehelde (DE)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 12/689,675

(22) Filed: Jan. 19, 2010

(51) Int. Cl.
*H01R 13/40* (2006.01)

(52) U.S. Cl. ..... 439/589; 439/271

(58) Field of Classification Search ..... 439/589, 439/587, 271
See application file for complete search history.

(56) References Cited

U.S. PATENT DOCUMENTS

| | | | | |
|---|---|---|---|---|
| 3,294,993 | A | 12/1966 | Komor et al. | |
| 3,604,964 | A | 9/1971 | Conrad et al. | |
| 3,736,548 | A | 5/1973 | Double | |
| 3,795,883 | A | 3/1974 | Ackerman et al. | |
| 3,952,218 | A | 4/1976 | Deters | |
| 4,460,295 | A | 7/1984 | Migliarese-Caputi et al. | |
| 4,859,200 | A | 8/1989 | McIntosh et al. | |
| 4,907,980 | A | 3/1990 | Wagaman et al. | |
| 5,221,214 | A | 6/1993 | Martin | |
| 5,674,098 | A * | 10/1997 | Inaba et al. | 439/883 |
| 6,913,494 | B2 * | 7/2005 | Ward et al. | 439/752 |
| 7,540,775 | B2 * | 6/2009 | Eckel et al. | 439/587 |

FOREIGN PATENT DOCUMENTS

| | | |
|---|---|---|
| CA | 1107828 | 8/1981 |

* cited by examiner

*Primary Examiner*—Phuong K Dinh
(74) *Attorney, Agent, or Firm*—Dinsmore & Shohl LLP

(57) ABSTRACT

A power plug system for use with a submersible pump. One embodiment comprises a male plug end, a female plug end, and a plurality of seals. The male plug end comprises a housing and a conductive sleeve. The housing receives an electrically conductive cable and conducts an electric current from the cable to the conductive sleeve. The female plug end comprises a housing, a conductive pin, and a female plug sleeve. The conductive sleeve is radially sealable within the female plug end through a plug end seal of the plurality of seals. The conductive sleeve and the conductive pin are conductively connectable. The female plug sleeve is radially sealable within a complementary plug end through a female plug sleeve seal of the plurality of seals. The conductive pin conductively connects to a conductive lead of the complementary plug end with insertion of the female plug sleeve therein.

20 Claims, 6 Drawing Sheets

POWER PLUG SYSTEM FOR SUBMERSIBLE PUMP SYSTEM

BACKGROUND

Embodiments of the present invention relate generally to power plug systems and, more particularly, to submersible pump systems comprising power plug systems.

Submersible pumps are driven by submersible motors and generally are operable in a variety of applications in which typically both the pump and the motor are completely submersed in a well liquid. The motor for the submersible pump generally is placed in the well below the pump section. To connect the motor to a power source located on the ground surface above the well, a power plug system having a power cable and plug ends is needed. Conventional power plug systems, however, generally are not applicable to deep well environments where high temperatures and high pressures typically are present.

More particularly, for deep well applications, the connection between interconnecting plug ends of a power plug system and their connection to a motor must be robust, secure, and substantially leak-poof. The connection between plug ends also should be configured for easy handling on site, particularly during the installation of the submersible pump system in the well. Further, a connection between a power cable and a plug end (generally via an end splice) should be sufficiently tight so as not to be compromised in ambient conditions in a well and/or inside the motor.

Generally, conventional power plug systems are not configured to maintain a secure, leak-proof electrical connection under deep well conditions. For example, typically, plug ends of conventional power plug systems are sealed only with an axial sealing that is provided with a connection of corresponding plug ends. Under deep well conditions, however, axial sealing alone generally is insufficient to prevent fluid leakage between connected plug ends. Further, the materials from which conventional power plug systems generally are configured and the configurations of the plug ends generally are not suitable for operation in deep well environments where high temperatures and high pressures can degrade and promote failure of the plug systems.

In addition, conventional power plug systems generally are not easy to assemble and generally do not have a modular configuration so that the plug systems and ends may interconnect in a series. As such, based on the foregoing, there exists a need for a power plug system suitable for operation in deep well and that is easy to assemble and has a modular configuration.

SUMMARY

It is against the above background that embodiments of the present invention provide power plug systems suitable for use with deep well submersible pump systems, particularly those operable in high temperature and high pressure environments. The embodiments provide an easy handling power plug system for connecting power cables in a substantially linear, strain-relieved manner. The power plug system is operable in high temperature and high pressure environments and may be designed for a voltage of at least about 5,000 volts and a current of at least about 250 amperes. The materials forming the power plug system generally are durable and resilient in high temperatures and high pressures of the motor cooling liquid inside of the submersible motor and of the well fluid in which the submersible pump system may be submersed.

Further, the power plug system comprises a modular configuration and, as such, may form not only a plug-connection between two power cables (cable extension), but also a series of two or more interconnected corresponding plug systems that may span to connect a power source located above a ground surface proximal to the well head and a well-submersed motor of a DWS pump system. For example, a male plug end of a power plug system, as described herein, may be connected to a female plug end of a well head plug or directly to a power source. The female plug end of the power plug system, as described herein, opposite of the male plug end may be connected to a male plug end of a second power plug system. This configuration may continue in series indefinitely until the female plug end of the last power plug system in the series may be connected to a male plug end of a submersible motor.

In addition, the plug ends of the power plug system may comprise a contact spring to enhance contact between male and female plug ends. Also, the power plug system may further comprise a seal or gasket to provide a radial sealing to connected plug ends in addition to the axial sealing typically provided with interconnection. Thereby, the seal or gasket further secures a connection between plug ends and provides a reliable seal between connected plug ends to avoid assembling errors and/or fluid leakage, particularly in high temperature and high pressure conditions.

In accordance with one embodiment, a power plug system comprises an electrically conductive cable, a male plug end, a female plug end and a plurality of seals. The male plug end comprises a housing and a conductive sleeve. The housing is operable to receive an end portion of the cable and to conduct an electric current from the cable to the conductive sleeve. The end portion of the cable is radially sealable within the housing via a cable seal of the plurality of seals. The female plug end comprises a housing, a conductive pin, a contact spring, and a female plug sleeve. The conductive sleeve of the male plug end is radially sealable within the housing of the female plug end via a plug end seal of the plurality of seals with insertion of the conductive sleeve into the housing of the female plug end. The conductive pin is radially sealed within the female plug sleeve via a conductive pin seal of the plurality of seals and is positioned to insert into the conductive sleeve. The contact spring is operable to enhance conduction between the conductive sleeve and the conductive pin. A female plug sleeve seal of the plurality of seals is provided to an exterior surface of the female plug sleeve that is operable to radially seal the female plug sleeve within a complementary plug end with insertion of the female plug sleeve therein. The conductive pin is operable to conductively connect to a conductive lead of the complementary plug end with insertion of the female plug sleeve therein.

Optionally, the housing of the male plug end may comprise an external shell, a cable receiver and an insulative sleeve. The cable receiver may be operable to receive the end portion of the cable and may be radially sealed within the external shell via a cable receiver seal of the plurality of seals. The insulative sleeve may be operable to guide the end portion of the cable to the conductive sleeve and may be radially sealed within the cable receiver via an insulative sleeve seal of the plurality of seals. The housing of the male plug end further may comprise a conductive receptacle positioned internally to the insulative sleeve and may be operable to conductively connect to a conductive lead of the cable. The conductive receptacle may be conductively connected to the conductive sleeve. The conductive sleeve may be positioned internally to the insulative sleeve and operable to conductively connect to the conductive pin of the female plug end.

Further, the housing of the female plug end may comprise an external shell and a sleeve receptacle. The female plug sleeve may be radially sealed within the external shell through an external shell seal of the plurality of seals. A portion of the female plug sleeve may be exposed from the external shell of the housing of the female plug end for insertion into the complementary plug end. The female plug sleeve seal may be provided to the exposed portion of the female plug sleeve and operable to radially seal the exposed portion within the complementary plug end. The sleeve receptacle may be operable to guide the conductive sleeve of the male plug end over the conductive pin of the female plug end with insertion of the conductive sleeve into the sleeve receptacle. The conductive pin may extend into both the sleeve receptacle and the female plug sleeve.

Further, optionally, the contact spring may comprise a silver-coated metal spring. Also, the plurality of seals may respectively comprise at least one of an o-ring, a gasket, and an elastomeric washer. The plurality of seals may provide a radial sealing sufficient to substantially withstand a pressure of at least about 50 bar. The cable may comprise a flat power cable radially sealed within the housing in a substantially linear, strain-relieved manner. The plug system may be configured of one or more materials comprising a resiliency sufficient to substantially withstand degradation in temperatures of at least about 160° C.

In accordance with another embodiment, a power plug system comprises a male plug end, a female plug end, and a plurality of seals. The male plug end comprises a housing and a conductive sleeve. The housing is operable to receive an end portion of an electrically conductive cable and to conduct an electric current from the cable to the conductive sleeve. The female plug end comprises a housing, a conductive pin, a contact spring, and a female plug sleeve. The conductive sleeve of the male plug end is radially sealable within the housing of the female plug end via a plug end seal of the plurality of seals with insertion of the conductive sleeve into the housing of the female plug end. The conductive sleeve and the conductive pin are operable to conductively connect with insertion of the conductive sleeve into the housing of the female plug end. The contact spring is operable to enhance conduction between the conductive sleeve and the conductive pin. A female plug sleeve seal of the plurality of seals is provided to an exterior surface of the female plug sleeve that is operable to radially seal the female plug sleeve within a complementary plug end with insertion of the female plug sleeve therein. The conductive pin is operable to conductively connect to a conductive lead of the complementary plug end with insertion of the female plug sleeve therein.

In accordance with yet another embodiment, a submersible pump system comprises a submersible pump, a submersible motor and a power plug system. The plug system is operable to conduct an electric current to the submersible motor for operation of the submersible pump. The plug system comprises an electrically conductive cable, a male plug end, a female plug end, and a plurality of seals. The male plug end comprises a housing and a conductive sleeve. The housing is operable to receive an end portion of the cable and to conduct the electric current from the cable to the conductive sleeve. The female plug end comprises a housing, a conductive pin, a contact spring, and a female plug sleeve. The conductive sleeve of the male plug end is radially sealable within the housing of the female plug end via a plug end seal of the plurality of seals with insertion of the conductive sleeve into the housing of the female plug end. The conductive sleeve and the conductive pin are operable to conductively connect with insertion of the conductive sleeve into the housing of the female plug end. The contact spring is operable to enhance conduction between the conductive sleeve and the conductive pin. A female plug sleeve seal of the plurality of seals is provided to an exterior surface of the female plug sleeve that is operable to radially seal the female plug sleeve within a complementary plug end of the submersible motor with insertion of the female plug sleeve therein. The conductive pin is operable to conductively connect to a conductive lead of the complementary plug end with insertion of the female plug sleeve therein.

BRIEF DESCRIPTION OF THE DRAWINGS

The following detailed description of specific embodiments can be best understood when read in conjunction with the following drawings, where like structure is indicated with like reference numerals and in which.

Figure 1:
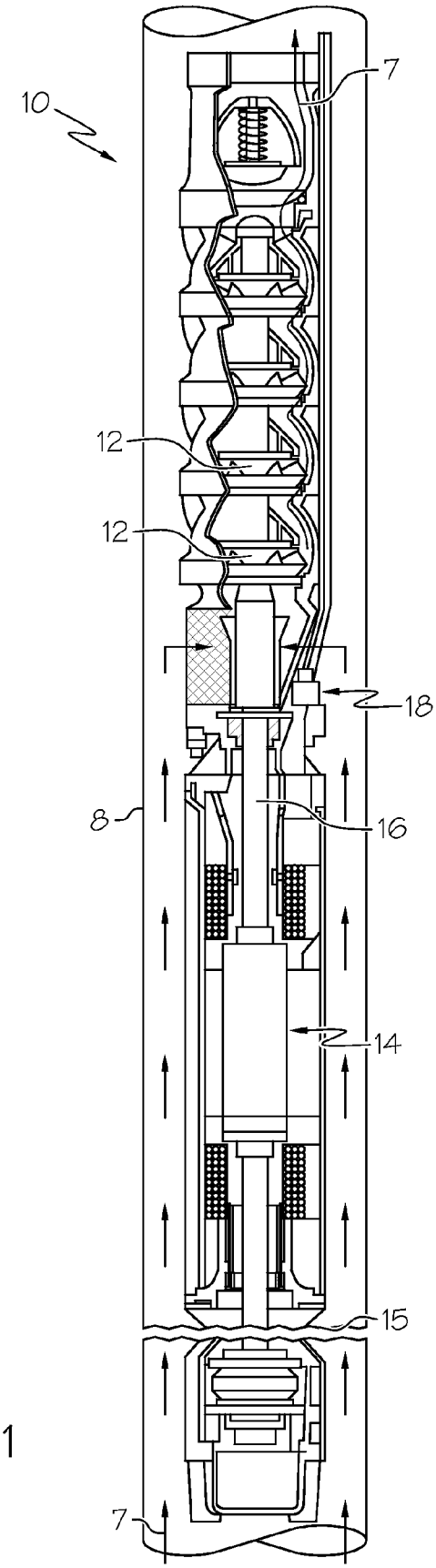
FIG. 1 is an illustration of a cross-sectional view of a submersible pump system according to one embodiment of the present invention.

The embodiments set forth in the drawings are illustrative in nature and are not intended to be limiting of the embodiments defined by the claims. Moreover, individual aspects of the drawings and the embodiments will be more fully apparent and understood in view of the detailed description that follows.

DETAILED DESCRIPTION

Referring initially to FIG. 1, embodiments of the present invention relate generally to a submersible pump system 10 that generally comprises a submersible pump 12, a submersible motor 14, a drive shaft 16 and a power plug system 18. The submersible pump 12 may be any conventional or yet to be developed submersible pump operable to perform for the purposes described herein. The submersible pump 12 generally is any pump operable when submersed in a liquid 7, such as in a well 8, and operable to propel at least a portion of the liquid into which the pump 12 is submersed upwards to a higher surface. In one particular form, the pump 12 may form a deep-well submersible (DWS) pumping system (also referred to as electric submersible pump (ESP)); such pumps are especially useful in extracting valuable resources such as oil, gas and water from deep well geological formations. In one particular operation, a DWS pump unit can be used to retrieve geothermal resources, such as hot water, from significant subterranean depths. In the configuration depicted in FIG. 1, the generally centrifugal pump 12 and motor 14 are axially aligned with one another and oriented vertically in the well. More particularly, the motor 14 is situated at the lower end of the system 10, and drives one or more pumps 12 arranged in stages mounted above.

The submersible motor 14 also may be any conventional or yet to be developed submersible motor operable to perform for the purposes described herein. The submersible motor 14 generally is any motor operable when submersed in a liquid and operable to drive the submersible pump 14 in propelling the liquid to the higher surface. More particularly, the submersible motor 14 comprises at least one stator that drives rotation of at least one rotor. The drive shaft 16, which also may be any conventional or yet to be developed drive shaft operable to perform for the purposes described herein, connects the submersible motor 14 and the submersible pump 12. Rotation of the rotor by the stator in the submersible motor 14 rotates the drive shaft 16, which drives the submersible pump 12 and the resultant propulsion of the liquid. The power plug system 18 provides connectivity for the electric power necessary for operation of the submersible motor 14. In one form, the motor 14 is an induction motor (for example, a squirrel-cage motor) that includes a rotor and stator that operate by induction motor and related electromagnetic principles well-known to those skilled in the art. Electric current is provided to the motor 14 from a power line or related source through a cable made from copper or a related electrically-conductive material.

Because DWS pumping systems are relatively inaccessible (often completely submerged at distances between about 400 and 700 meters beneath the earth's surface), they must be able to run for extended periods without requiring maintenance. Such extended operating times are especially hard on the electrical connectors, where high temperature, pressure and often vibratory environments may adversely impact a secure connection between an external power source (such as line power) and motor 14 used to power the pump 12. the Embodiments of the present invention also relate generally to the power plug systems 18, which may include seals to radially set positional relationships of various components of the plug system 18, but also establish a connection between male and female plug ends of the plug system 18. An axial sealing of a connection between male and female plug ends generally is provided with compressing the plug ends against each other to provide an electrical connection. Axial sealing, however, generally is insufficient to substantially prevent fluid leakage between connected plug ends, particularly in high pressure environments where fluid may seep or otherwise advance at the point of connection between the two plug ends and between various respective components thereof, thereby interfering with conduction and operation of the plug system 18.

This radial sealing and connection between the male and female plug ends supplements the axial sealing, thereby substantially preventing fluid leakage into the plug system 18. Thus, in turn enables plug system 18 to substantially withstand significant pressures typically present in deep well environments. For example, in one embodiment, the radial sealing can withstand a pressure of about 50 bar. In addition, radial sealing lengthens the operating life of the plug system 18 and expands the environmental realms in which the plug system 18 may function with a desirable reliability and durability. For example, the plug system 18 may be used not only in both non-submersed and submersed environments, but also under one or both of high temperature (e.g., at least about 160° C.) and high pressure (e.g., at least about 50 bar) environmental conditions.

As shown in FIGS. 2 through 6, the plug system 18 comprises an electrically conductive cable 20, a male plug end 22 and a female plug end 24. The present inventors also contemplate embodiments in which the cable 20 is not included as a component of the plug system 18. As mentioned above, the plug system 18 also comprises numerous seals that provide radial sealing to at least one of components of the male plug end 22, female plug end 24 and an interconnection between them. The seals may comprise at least one of o-rings, gaskets, elastomeric washers, or other related sealing devices. In addition, the seals are generally made from one or more materials durable in high temperature and/or high pressure environments. For example, the seals may possess a resiliency sufficient to substantially withstand degradation in temperatures of at least about 160° C. and pressures of at least about 50 bar.

The electrically conductive cable 20 may be any conventional submersible electrically conductive cable known in the art. The cable 20 generally is any cable comprising a conductive lead 28 enclosed in an insulative coating 30 or housing. For example, in one embodiment, the cable comprises a flat power cable. The cable 20 may be operable to conduct an electric current from a power source, generally above a ground surface, to the submersible motor 14 positioned beneath the ground surface in a well.

The male plug end 22 comprises a housing 32 and a conductive sleeve 34. The housing 32 is operable to receive an end portion 36 of the cable 20 and to conduct the electric current provided by the cable 20 to the conductive sleeve 34. More particularly, the housing 32 of the male plug end 22 generally comprises an external shell 38, a cable receiver 40, an insulative sleeve 42 and a cable receptacle 44. The cable receiver 40 is positioned at an end of the male plug end 22 opposite of the conductive sleeve 34. Further, the cable receiver 40 generally is positioned partially internal to the external shell 38 and may be radially sealed therein via cable receiver seal 43 of the plurality of seals to substantially prevent fluid leakage between the external shell 38 and the cable receiver 40. The cable receiver 40 generally is operable to receive the end portion 36 of the cable 20 and guide it toward the conductive sleeve 34. The end portion 36 of the cable 20 may be radially sealed within the housing 32, in particular, the cable receiver 40, via cable seal 45. The end portion 36 of the cable 20, particularly when the cable 20 comprises a flat power cable, may be radially sealed within the housing 32 in a substantially linear, strain-relieved manner to reduce fatigue of the cable 20 and to enhance the operating life of the cable 20 and thus, the plug system 18.

The insulative sleeve 42 of the male plug end housing 32 generally is positioned inside of the external shell 38 and partially inserts into the cable receiver 40. An insulative sleeve seal 47 of the plurality of seals may be provided at, or near, an area of insertion of the insulative sleeve 42 into the cable receiver 40 to prevent fluid leakage therebetween. As such, the insulative sleeve 42 may be radially sealed within the cable receiver 40 via the insulative sleeve seal 47.

The conductive receptacle 44 is positioned internally to the insulative sleeve 42 and is operable to electrically connect to the conductive lead 28 of the cable 20. More particularly, the insulative sleeve 42 guides the end portion 36 of the cable 20 from the cable receiver 40 to the cable receptacle 44. The conductive receptacle 44 receives and connects to the conductive lead 28 exposed from the insulative coating 30 of the cable 20 and is also conductively connected to the conductive sleeve 34 so that the conductive receptacle 44 conducts the electric current from the conductive lead 28 of the cable 20 to the conductive sleeve 34.

The conductive sleeve 34 is positioned internally to the insulative sleeve 42 and the external shell 38. The portion 39 of the external shell 38 covering the conductive sleeve 34 is configured to insert into the female plug end 24 so that the conductive sleeve 34 may insert therein and conductively connect to the female plug end 24. More particularly, the female plug end 24 comprises a housing 46, a conductive pin 48, a contact spring 50 and a female plug sleeve 52. The housing 46 comprises an external shell 54 and a sleeve receptacle 56. The female plug sleeve 52 is positioned internally to the external shell 54 of the housing 46 and may be radially sealed within the external shell 54 with an external shell seal 53 of the numerous seals to substantially prevent fluid leakage therebetween. Further, the conductive pin 48 is positioned internally to the female plug sleeve 52 and may be radially sealed within the female plug sleeve 52 via conductive pin seal 55 of the plurality of seals.

The sleeve receptacle 56 of the housing 46 of the female plug end 24 generally is defined by the external shell 54, the conductive pin 48, and the female plug sleeve 52. The sleeve receptacle 56 generally comprises a configuration complementary to those of the conductive sleeve 34 and the portion 39 of the external shell 38 covering it. The conductive sleeve 34 is radially sealable within the sleeve receptacle 56 via plug end seal 57 of the plurality of seals with insertion of the conductive sleeve 34 into the sleeve receptacle 56 such that the male and female plug ends 22, 24 are interconnected. Thus, the plug end seal 57 provides a radial sealing and substantially prevents fluid leakage between the male plug end 22 and the female plug end 24 when interconnected. For example, in one embodiment, shown in FIG. 4, the portion 39 of the external shell 38 insertable into the sleeve receptacle 56 comprises a plug end seal 57 provided to an exterior surface thereof. Thus, with insertion of the portion 39 of the external shell 38 into the sleeve receptacle 56, the external shell 38 is radially sealable within the sleeve receptacle 56 via the plug end seal 57.

Further, the sleeve receptacle 56 is operable to guide the conductive sleeve 34 of the male plug end 22 over the conductive pin 48 of the female plug end 24 with insertion of the conductive sleeve 34 into the sleeve receptacle 56. The conductive pin 48 is positioned such that it extends into both the sleeve receptacle 56 and the female plug sleeve 52. With insertion into the sleeve receptacle 56, the conductive sleeve 34 is operable to conductively connect to the conductive pin 48 so that the electric current is conducted from the male plug end 22 to the female plug end 24.

The contact spring 50 of the female plug end 24 is operable to enhance conduction between the conductive sleeve 34 and the conductive pin 48 when conductively connected. Generally, the contact spring 50 is provided to an exterior surface of the conductive pin 48. At least a portion of the contact spring 50 generally is elevated relative to the exterior surface of the conductive pin 48 so as to engage an interior surface of the conductive sleeve 34 with insertion of the conductive sleeve 34 into the sleeve receptacle 56 and over the conductive pin 48. The present inventors also contemplate, however, that the contact spring 50 may be provided to the interior surface of the conductive sleeve 34 and elevated relative thereto so as to engage the exterior surface of the conductive pin 48 with insertion of the conductive sleeve 34 into the sleeve receptacle 56 and over the conductive pin 48. The contact spring 50 generally is made up of one or more highly conductive materials to enhance electrical connectivity. For example, in one embodiment, the contact spring 50 comprises a silver-coated metal spring.

While, as mentioned above, the female plug sleeve 52 is positioned internally to the external shell 54 of the housing 46 of the female plug end 24, a portion 58 of the female plug sleeve 52 is exposed from the external shell 54. This exposed portion 58 of the female plug sleeve 52 is configured to insert into a plug end 60 complementary thereto. This complementary plug end 60 may be any conventional or yet to be developed plug end that is operable to perform as described herein. The exposed portion 58 of the female plug sleeve 52 may comprise a female plug sleeve seal 59 of the plurality of seals. The female plug sleeve seal 59 generally is provided to an exterior surface of the female plug sleeve 52. Thus, with insertion of the exposed portion 58 into the complementary plug end 60, the female plug sleeve 52 may be radially sealed within the complementary plug end 60 via the female plug sleeve seal 59. Further, as mentioned above, with the conductive pin 48 extending into the female plug sleeve 52, the conductive pin 48 is operable to conductively connect to a conductive lead 62 of the complementary plug end 60 with insertion of the female plug sleeve 52 therein. Thereby, electric current from the cable 20 may be conducted through interconnected male and female plug ends 22, 24 to the complementary plug end 60.

The complementary plug end 60 generally is integrated, conductively connected component of a submersible motor 14 of a submersible pump system 10. As such, a cable 20 of a plug system 18 of the pump system 10 may conduct an electric current from a power source, generally located above a ground surface, to interconnected male and female plug ends 22, 24 of the plug system 18, generally located beneath the ground surface, through the complementary plug end 60, and to the submersible motor 14 to power operation thereof.

Figure 2:
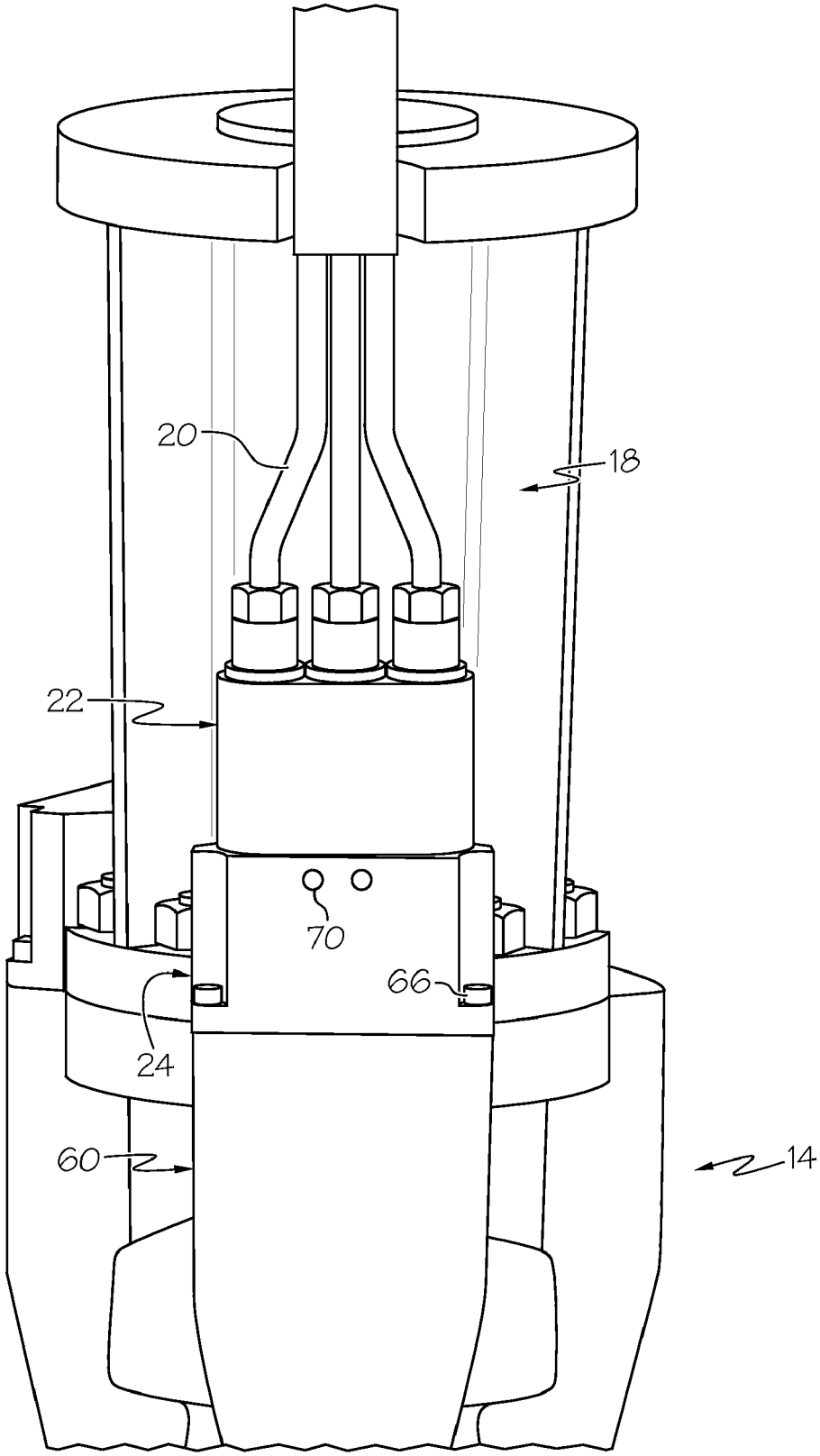
FIG. 2 is an illustration of a view of a power plug system according to another embodiment of the present invention.

Further, at least one of the male and female plug ends 22, 24 may be securable to the housing 64 of the complementary plug end 60 to releasably secure a connection of the female plug end 24 to the complementary plug end 60. For example, as shown in FIG. 2, one or more screws 66 may pass through apertures in the housing 46 of the female plug end 24 and thread into complementary apertures in the housing 64 of the complementary plug end 60.

Figure 3:
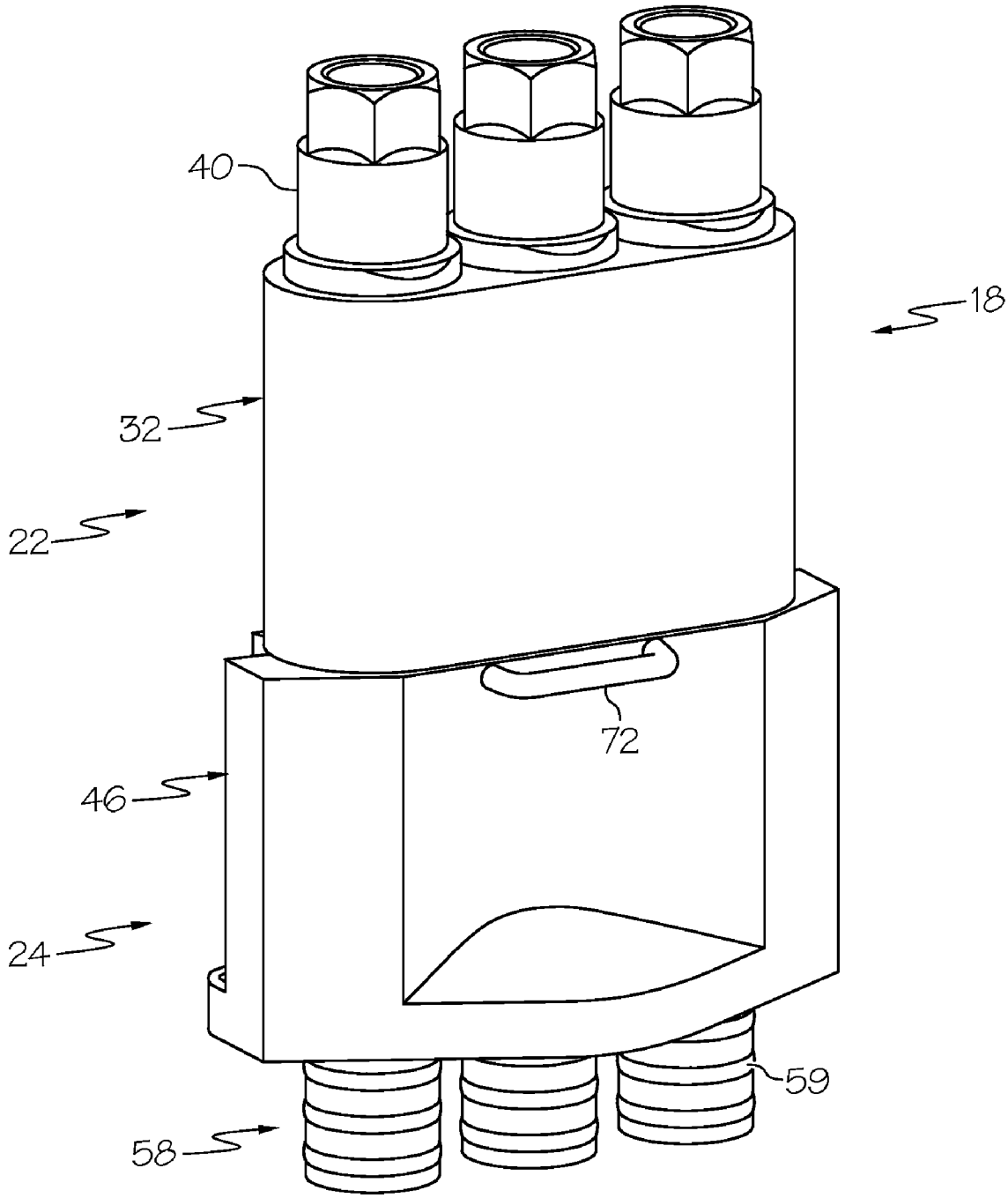
FIG. 3 is an illustration of a view of an interconnected male plug end and female plug end of a power plug system according to another embodiment of the present invention.
Figure 4:
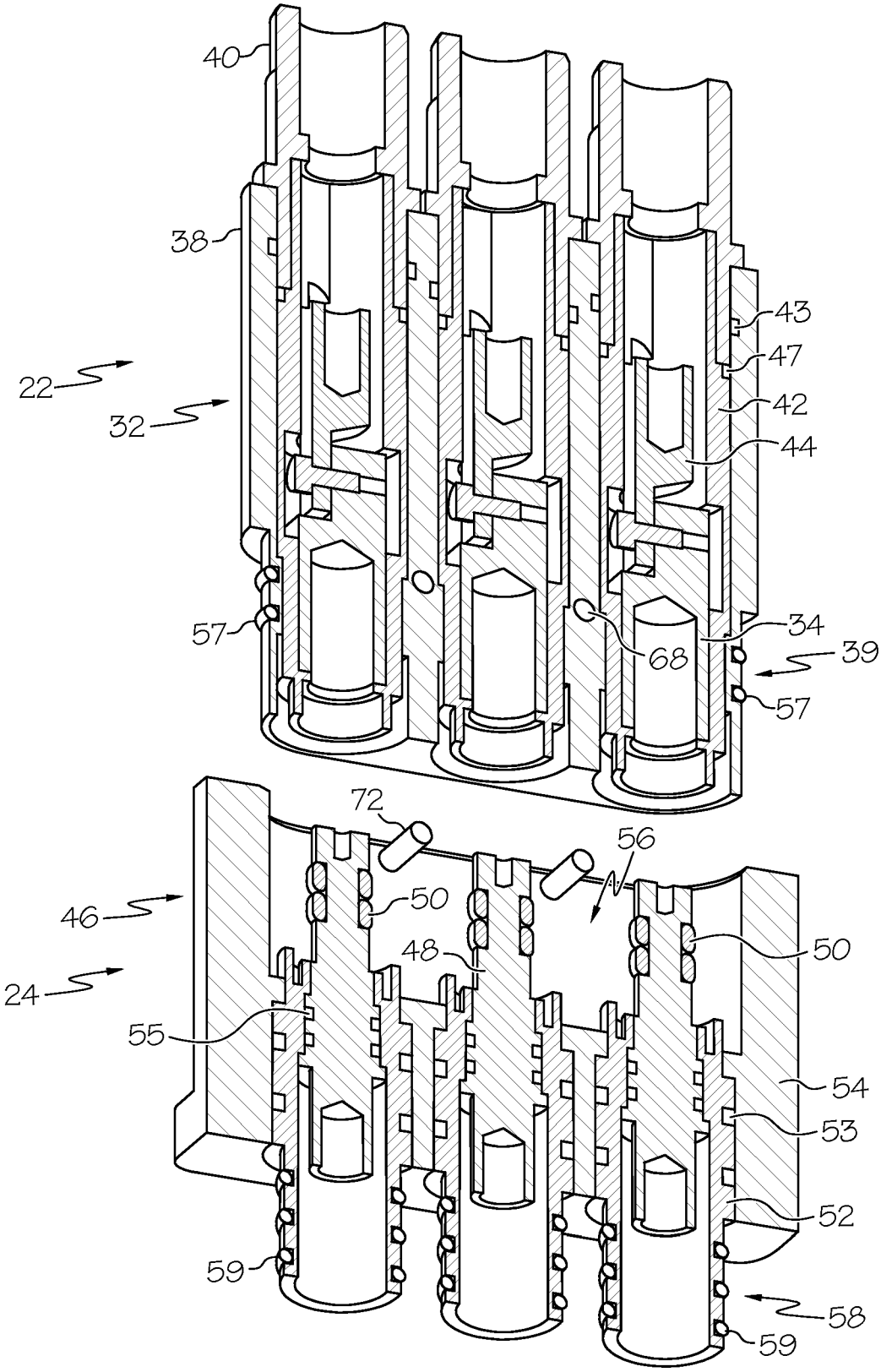
FIG. 4 is an illustration of a cross-sectional view of a male plug end and a female plug end of a power plug system according to another embodiment of the present invention.
Figure 5:
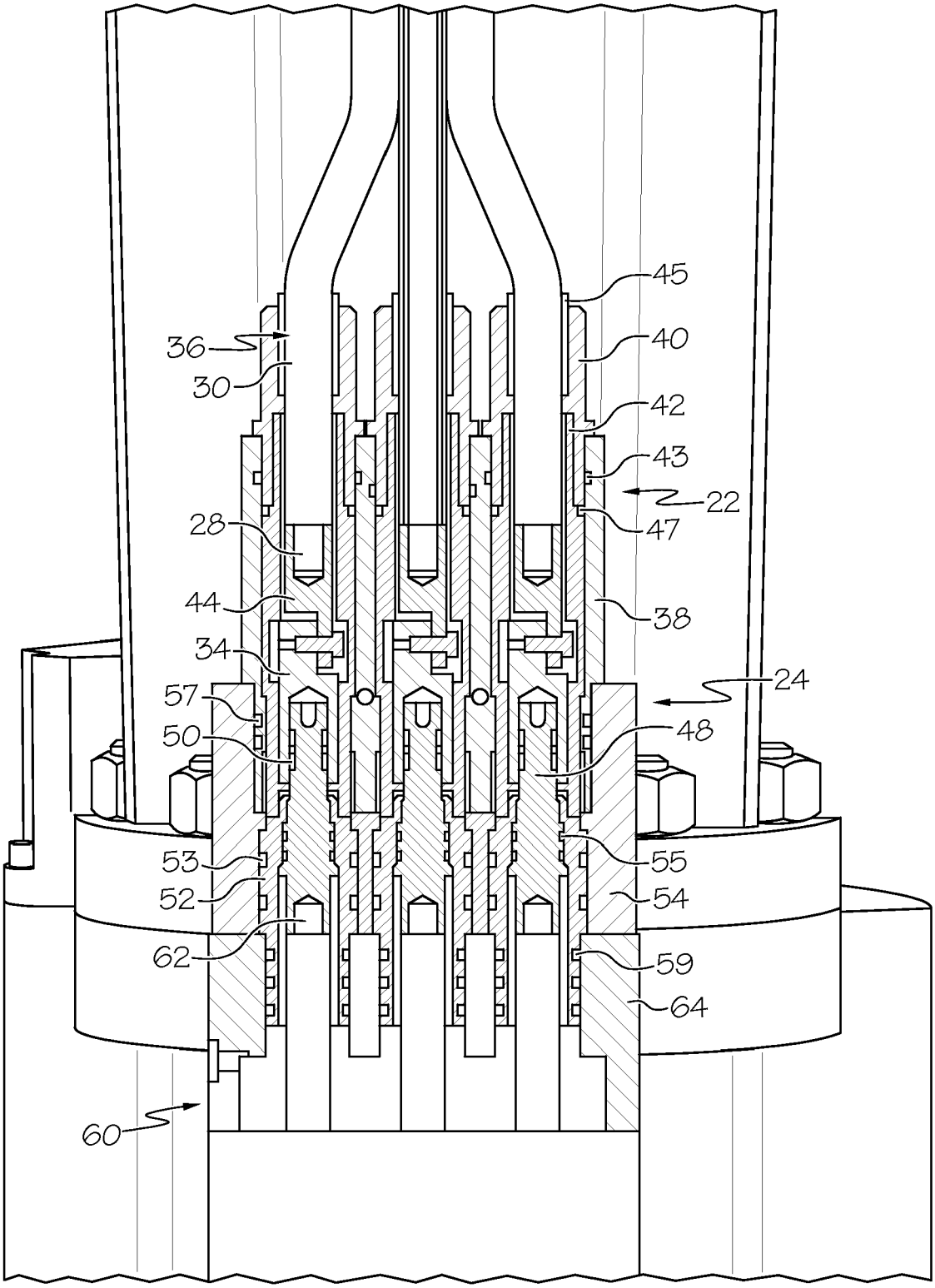
FIG. 5 is an illustration of a cross-sectional view of a power plug system according to another embodiment of the present invention.
Figure 6:
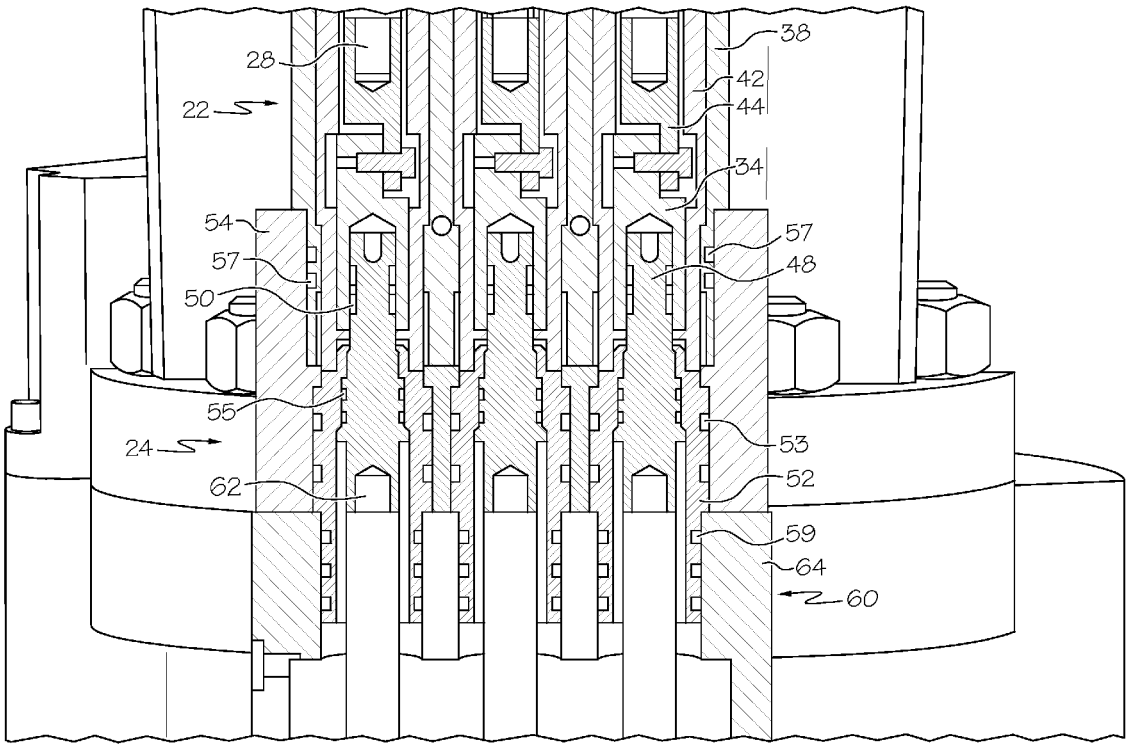
FIG. 6 is an illustration of a magnified view of the embodiment of the power plug system illustrated in FIG. 5.

In addition, at least one of the male and female plug ends 22, 24 may be configured to secure to the other of the male and female plug end 22, 24 with insertion of the male plug end 22 of the first into the female plug end 24 of the second. For example, as shown in FIGS. 2 through 4, the male and female plug ends 22, 24 may respectively comprise one or more apertures 68, 70 that substantially align with insertion of the male plug end 22 into the female plug end 24. The plug system 18 may comprise a pin 72 insertable into the aligned apertures 68, 70 so as to secure the connection between the male and female plug ends 22, 24. Optionally, the female 24 and male 22 plug parts can also be fixed by screws at the left and right side of the plug system 18. The pin 72 may be withdrawn from the aligned apertures 68, 70 to permit a disconnection of the plug ends 22, 24 when desired.

As discussed above, the components forming the plug system 18 may be made from materials durable in environments having at least one of high temperature and high pressure (such as at least about 160° C. and or pressures of at least about 50 bar). For example, at least the external shells 38, 54 of the male plug end 22 and the female plug end 24 may be configured at least partially of high grade stainless steel.

While the embodiments of the plug system 18 illustrated in FIGS. 2 through 6 are respectively operable to conduct one or more electric currents between three cables 20 of the plug system 18 and three conductive leads 62 of the complementary plug end 60, the present inventors contemplate that embodiments of the plug system 18 may be operable to conduct electric current between any number of cables 20 and any number of conductive leads 62, whether greater or lesser than that illustrated in the drawings. The number of cables 20 and conductive leads 62 provided may determined by or associated with the amount of electric current required or desired to power a motor to which the plug system 18 is conductively connected.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly, " and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More particularly, although some aspects of embodiments of the present invention may be identified herein as preferred or particularly advantageous, it is contemplated that the embodiments of the present invention are not necessarily limited to these aspects.

What is claimed is:

1. A power plug system comprising an electrically conductive cable, a male plug end, a female plug end, and a plurality of seals, wherein:

the male plug end comprises a housing and a conductive sleeve;

the housing is operable to receive an end portion of the cable and to conduct an electric current from the cable to the conductive sleeve;

the end portion of the cable is radially sealable within the housing through cable seal of the plurality of seals;

the female plug end comprises a housing, a conductive pin, a contact spring, and a female plug sleeve;

the conductive sleeve of the male plug end is radially sealable within the housing of the female plug end through plug end seal of the plurality of seals with insertion of the conductive sleeve into the housing of the female plug end;

the conductive pin is radially sealed within the female plug sleeve through a conductive pin seal of the plurality of seals and is positioned to insert into the conductive sleeve;

the contact spring is operable to enhance conduction between the conductive sleeve and the conductive pin;

a female plug sleeve seal of the plurality of seals is provided to an exterior surface of the female plug sleeve that is operable to radially seal the female plug sleeve within a complementary plug end with insertion of the female plug sleeve therein; and the conductive pin is operable to conductively connect to a conductive lead of the complementary plug end with insertion of the female plug sleeve therein.

2. The plug system of claim 1, wherein the housing of the male plug end comprises an external shell, a cable receiver, and an insulative sleeve.

3. The plug system of claim 2, wherein the cable receiver is operable to receive the end portion of the cable and is radially sealed within the external shell through a cable receiver seal of the plurality of seals.

4. The plug system of claim 2, wherein the insulative sleeve is operable to guide the end portion of the cable to the conductive sleeve and is radially sealed within the cable receiver through an insulative sleeve seal of the plurality of seals.

5. The plug system of claim 2, wherein the housing of the male plug end further comprises a conductive receptacle positioned internally to the insulative sleeve and is operable to conductively connect to a conductive lead of the cable.

6. The plug system of claim 5, wherein the conductive receptacle is conductively connected to the conductive sleeve.

7. The plug system of claim 2, wherein the conductive sleeve is positioned internally to the insulative sleeve and is operable to conductively connect to the conductive pin of the female plug end.

8. The plug system of claim 1, wherein the housing of the female plug end comprises an external shell and a sleeve receptacle.

9. The plug system of claim 8, wherein the female plug sleeve is radially sealed within the external shell through an external shell seal of the plurality of seals.

10. The plug system of claim 9, wherein a portion of the female plug sleeve is exposed from the external shell of the housing of the female plug end for insertion into the complementary plug end.

11. The plug system of claim 10, wherein the female plug sleeve seal is provided to the exposed portion of the female plug sleeve and is operable to radially seal the exposed portion within the complementary plug end.

12. The plug system of claim 8, wherein the sleeve receptacle is operable to guide the conductive sleeve of the male plug end over the conductive pin of the female plug end with insertion of the conductive sleeve into the sleeve receptacle.

13. The plug system of claim 8, wherein the conductive pin extends partially into both the sleeve receptacle and the female plug sleeve.

14. The plug system of claim 1, wherein the contact spring comprises a silver-coated metal spring.

15. The plug system of claim 1, wherein the plurality of seals respectively comprise at least one of an o-ring, a gasket and an elastomeric washer.

16. The plug system of claim 1, wherein the plurality of seals provide a radial sealing sufficient to substantially withstand a pressure of at least about 50 bar.

17. The plug system of claim 1, wherein the cable comprises a flat power cable that is radially sealed within the housing in a substantially linear, strain-relieved manner.

18. The plug system of claim 1, wherein the plug system is configured of a material comprising a resiliency sufficient to substantially withstand degradation in temperatures of up to at least about 160° C.

19. A power plug system comprising a male plug end, a female plug end, and a plurality of seals, wherein:

the male plug end comprises an insulative housing and a conductive sleeve;

the housing is operable to receive an electrically conductive cable and to conduct an electric current from the cable to the conductive sleeve;

the female plug end comprises a housing, a conductive pin, a contact spring and female plug sleeve;

the conductive sleeve of the male plug end is radially sealable within the housing of the female plug end through a plug end seal of the plurality of seals with insertion of the conductive sleeve into the housing of the female plug end;

the conductive sleeve and the conductive pin are operable to conductively connect with insertion of the conductive sleeve into the housing of the female plug end;

the contact spring is operable to enhance conduction between the conductive sleeve and the conductive pin;

a female plug sleeve seal of the plurality of seals is provided to an exterior surface that female plug sleeve that is operable to radially seal the female plug sleeve within a complementary plug end with insertion of the female plug sleeve therein; and the conductive pin is operable to conductively connect to a conductive lead of the complementary plug end with insertion of the female plug sleeve therein.

20. A submersible pump system comprising a submersible pump, a submersible motor, and a power plug system, wherein:

the plug system is operable to conduct an electric current to the submersible motor for operation of the submersible pump;

the plug system comprises an electrically conductive cable, a male plug end, a female plug end and a plurality of seals;

the male plug end comprises a housing and a conductive sleeve such that the housing of the male plug end is operable to receive an end portion of the cable to permit the conduction of electric current from the cable to the conductive sleeve;

the female plug end comprises a housing, a conductive pin, a contact spring and a female plug sleeve;

the conductive sleeve of the male plug end is radially sealable within the housing of the female plug end through a plug end seal of the plurality of seals with insertion of the conductive sleeve into the housing of the female plug end;

the conductive sleeve and the conductive pin are operable to conductively connect with insertion of the conductive sleeve into the housing of the female plug end;

the contact spring is operable to enhance conduction between the conductive sleeve and the conductive pin;

a female plug sleeve seal of the plurality of seals is provided to an exterior surface of the female plug sleeve that is operable to radially seal the female plug sleeve within a complementary plug end of the submersible motor with insertion of the female plug sleeve therein; and the conductive pin is operable to conductively connect to a conductive lead of the complementary plug end with insertion of the female plug sleeve therein.

* * * * *